US011168519B2

(12) United States Patent
Foley et al.

(10) Patent No.: US 11,168,519 B2
(45) Date of Patent: Nov. 9, 2021

(54) ASSEMBLY FOR AN ARCHITECTURAL-STRUCTURE COVERING

(71) Applicant: Hunter Douglas Inc., Pearl River, NY (US)

(72) Inventors: Patrick E. Foley, Evergreen, CO (US); Donald J. Clark, Thornton, CO (US); Nicholas P. Andrews, Lafayette, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 244 days.

(21) Appl. No.: 16/016,014

(22) Filed: Jun. 22, 2018

(65) Prior Publication Data

US 2019/0024449 A1 Jan. 24, 2019

Related U.S. Application Data

(60) Provisional application No. 62/534,978, filed on Jul. 20, 2017, provisional application No. 62/550,848,
(Continued)

(51) Int. Cl.

| | |
|---|---|
| ***E06B 9/327*** | (2006.01) |
| ***E06B 9/388*** | (2006.01) |
| ***E06B 9/262*** | (2006.01) |

(52) U.S. Cl.

CPC ..... *E06B 9/327* (2013.01); *E06B 9/262* (2013.01); *E06B 9/388* (2013.01); *E06B 2009/2625* (2013.01)

(58) Field of Classification Search

CPC ..... B60J 1/2011; B60J 1/2044; B60J 1/2052; E06B 9/264; E06B 2009/2646;
(Continued)

(56) References Cited

U.S. PATENT DOCUMENTS

| | | | | |
|---|---|---|---|---|
| 2,349,470 A | | 5/1944 | Stanfield | |
| 4,374,536 A | * | 2/1983 | Becker | E06B 9/521 160/327 |

(Continued)

FOREIGN PATENT DOCUMENTS

| | | |
|---|---|---|
| CN | 105421932 A | 3/2016 |
| DE | 2834268 A1 | 2/1980 |

(Continued)

*Primary Examiner* — Daniel P Cahn

(74) *Attorney, Agent, or Firm* — Kacvinsky Daisak Bluni PLLC

(57) ABSTRACT

A mounting assembly for mounting an architectural-structure covering to an architectural structure, in particular a movable structure is disclosed. In use, the mounting assembly is used in combination with the architectural-structure covering so that the architectural-structure covering can be movable between a retracted position and an extended position. All the while, the mounting assembly constrains movement of the covering portion of the architectural-structure covering so that, for example, in use, when the mounting assembly is mounted to a movable structure, the covering is prevented from moving relative to (e.g., away from) the architectural structure when the movable structure is opened and closed.

15 Claims, 12 Drawing Sheets

Related U.S. Application Data filed on Aug. 28, 2017, provisional application No. 62/623,015, filed on Jan. 29, 2018.

(58) Field of Classification Search

CPC ..... E06B 2009/587; E06B 9/58; E06B 9/327; E06B 9/388; E06B 9/262; E06B 2009/2625; E06B 2009/2627; E06B 9/323; E06B 9/266; E06B 2009/2622; E06B 9/322; E06B 2009/3222; E06B 9/32; E06B 9/38; E06B 9/30; E06B 9/17061

See application file for complete search history.

(56) References Cited

U.S. PATENT DOCUMENTS 4,448,005 A 5/1984 Vochelli
4,557,310 A * 12/1985 Castellaw ..... A01G 9/22 160/84.06
4,665,964 A * 5/1987 Zommers ..... E04D 13/033 160/273.1
4,694,877 A * 9/1987 Dunbar ..... A01G 9/22 160/273.1
4,741,375 A * 5/1988 Milford ..... E06B 9/262 160/84.06
5,113,922 A * 5/1992 Christensen ..... E06B 9/388 160/172 R
5,269,360 A 12/1993 Chen
5,492,164 A * 2/1996 Gist ..... E06B 9/01 160/102
6,007,899 A 12/1999 Yoshizawa et al.
6,035,920 A * 3/2000 Lassen ..... E06B 9/32 160/172 R
6,640,867 B1 * 11/2003 Pallotta ..... E06B 9/266 160/84.04
7,954,537 B2 6/2011 Kraeutler
8,347,937 B2 * 1/2013 Murphy ..... E06B 9/262 160/84.04
9,206,639 B2 12/2015 Chen
9,347,258 B2 * 5/2016 Dwarka ..... E06B 9/24
9,353,529 B2 * 5/2016 Richmeier ..... E04F 10/02
9,382,756 B2 7/2016 Cheringal et al.
9,416,587 B2 8/2016 Colson et al.
9,784,030 B2 10/2017 Gardiner et al.
2001/0005002 A1 6/2001 Berman et al.
2002/0095886 A1 * 7/2002 Lindgren ..... E04D 13/02 52/204.1
2004/0031575 A1 * 2/2004 Nien ..... E06B 9/38 160/172 R
2005/0028944 A1 * 2/2005 Early ..... E06B 9/264 160/107
2005/0153517 A1 * 7/2005 Kim ..... E06B 9/323 438/396
2009/0165964 A1 * 7/2009 Harbison ..... E06B 9/58 160/327
2009/0199977 A1 * 8/2009 Bohlen ..... E06B 9/42 160/84.06
2010/0319861 A1 * 12/2010 Pelekanos ..... E06B 9/262 160/378
2012/0160429 A1 * 6/2012 Lin ..... E06B 9/42 160/291
2013/0174989 A1 * 7/2013 Ingram ..... E06B 9/262 160/84.04
2014/0000820 A1 * 1/2014 Diamond ..... E06B 9/58 160/323.1
2015/0101767 A1 * 4/2015 Chen ..... E06B 9/322 160/370
2015/0225996 A1 * 8/2015 Maksan ..... E06B 9/264 160/107
2017/0211315 A1 * 7/2017 Fleischman ..... E04B 1/0046
2017/0328068 A1 * 11/2017 Shargani ..... E04H 15/642

FOREIGN PATENT DOCUMENTS

DE 7904039 U1 7/1980
DE 7917517 U1 11/1980
DE 102014018562 6/2016
EP 0834414 A2 4/1998
EP 1020601 A2 7/2000
EP 2037077 A1 3/2009
EP 2236731 A2 10/2010
EP 2865840 A1 4/2015
EP 2865841 A1 4/2015
WO WO198800140 A1 1/1988
WO WO199718378 A1 5/1997
WO WO199832944 A1 7/1998
WO WO2007141031 A1 12/2007

* cited by examiner

ASSEMBLY FOR AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/534,978, filed Jul. 20, 2017, titled "Assembly for an Architectural-Structure Covering," and is a non-provisional of, and claims the benefit of the filing date of, U.S. provisional patent application No. 62/550,848, filed Aug. 28, 2017, titled "Assembly for an Architectural-Structure Covering," and is a non-provisional of, and claims the benefit of the filing date of, U.S. provisional patent application No. 62/623,015, filed Jan. 29, 2018, titled "Assembly for an Architectural-Structure Covering," the entirety of which applications are incorporated by reference herein.

FIELD OF THE DISCLOSURE

The present disclosure relates generally to a mounting assembly for use with architectural-structure coverings, and more particularly to a system and method for mounting an architectural-structure covering to a building structure, in particular a movable structure such as, for example, a door or movable widow (e.g., tilt window).

BACKGROUND OF THE DISCLOSURE

Architectural-structure coverings for architectural structures or openings, such as for example, windows, doors, archways, portions of a wall, and the like, have taken numerous forms for many years. One known architectural-structure covering includes a covering having an upper edge and a bottom edge, the bottom edge being movable towards the upper edge to retract the covering, and movable away from the upper edge to extend the covering. For example, the covering may be in the form of a stacked or tiered covering such as, for example, a honeycomb shade or the like. In use, the covering is movable between a retracted position and an extended position so that in the extended position, the underlying architectural structure is at least partially covered while, in the retracted position, the underlying architectural structure is at least partially exposed.

The architectural-structure covering may further include a bottom rail attached to the bottom edge of the covering. The bottom rail may be engaged by the user to move the covering between the extended and retracted positions, or to provide an aesthetic finish to an end of the covering. Alternatively, a drive mechanism such as, for example, a pull cord or chain, may be incorporated to enable the user to raise and lower the covering between the extended and retracted positions.

In some implementations however it may be necessary to secure or guide the bottom rail of the architectural-structure covering relative to the underlying structure. For example, in one embodiment, the architectural-structure covering may be mounted on a movable structure such as, for example, a movable door (e.g., French doors or the like), a movable window (e.g., a tiltable window, or a tilt & turn window (e.g., a window that can move about a horizontal axis and/or a vertical axis) or the like), etc. (collectively referred to herein as "movable structure" without the intent to limit). It should be understood that such movable structures are illustrative and that the present disclosure can be used in connection with any structure, whether movable or not, and said terminology is intended to be non-limiting. In such embodiments, it is desirable to constrain movement of the bottom rail so that the covering does not move or flop around with respect to the movable structure when the covering is in the extended position and the movable structure is moved. For example, it is desirable to prevent the architectural-structure covering from moving relative to the movable structure during opening and closing of the door, window, etc.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

The present disclosure is directed to a system and/or assembly for mounting an architectural-structure covering to an architectural structure, in particular a movable structure where it is beneficial to inhibit or constrain movement of a rail (e.g., bottom rail) of the architectural-structure covering to prevent the bottom of the architectural-structure covering from moving relative to the movable structure.

In use, the mounting assembly may be used in combination with the architectural-structure covering so that the architectural-structure covering can be movable between a retracted position and an extended position. All the while, the mounting assembly may be adapted and configured to constrain movement of the covering portion of the architectural-structure covering so that, for example, in use, when the mounting assembly is mounted to a movable structure, the bottom portion of the covering is prevented from moving relative to the movable structure.

In one non-limiting example embodiment, the mounting assembly may include a pair of side tracks for mounting on either side of the architectural structure (e.g., movable structure). The mounting assembly may further include mounting brackets for coupling a headrail of the architectural-structure covering to the side tracks, and rail clips for coupling a rail such as, for example, a bottom rail of the architectural-structure covering to the side tracks.

In use, the rail clips may be at least partially received within a channel formed in the side tracks and may be coupled to the rail (e.g., bottom rail) of the architectural-structure covering. The rail clips may be movably positionable (e.g., slidable) with respect to the side tracks so that the rail clips, and hence the rail (e.g., bottom rail) of the architectural-structure covering coupled thereto, are movable with respect to the headrail. In this manner, the covering of the architectural-structure covering may be movable between extended and retracted positions, all the while, the rail (e.g., bottom rail) of the architectural-structure covering is constrained by the mounting assembly to prevent the covering from moving relative to the underlying architectural structure (e.g., movable structure).

In one non-limiting example embodiment, the rail clips are arranged and configured so that the covering of the architectural-structure covering is positioned forward of the first and second side tracks such that, in the extended configuration, the architectural-structure covering overlies the first and second side tracks.

Figure 1:
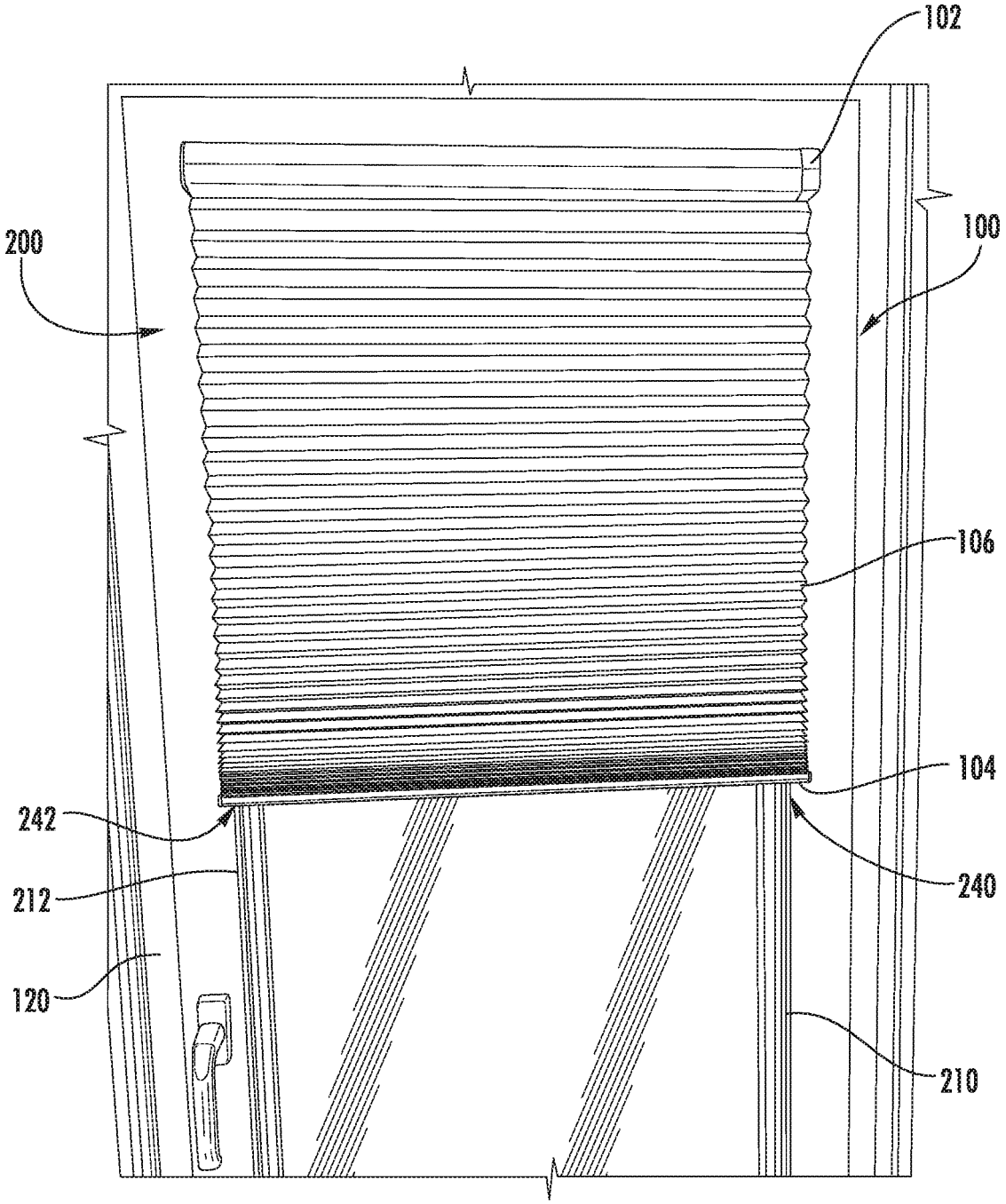
FIG. 1 is a perspective view illustrating an example embodiment of a mounting assembly according to aspects of the present disclosure, the mounting assembly being mounted to a door.

The drawings are not necessarily to scale. The drawings are merely representations, not intended to portray specific parameters of the disclosure. The drawings are intended to depict non-limiting example embodiments of the disclosure, and therefore are not be considered as limiting in scope. In the drawings, like numbering represents like elements.

DETAILED DESCRIPTION

Embodiments of a system and/or assembly (used interchangeably herein) for mounting an architectural-structure covering to an architectural structure such as, for example, a window, frame adjacent to the window, a door, etc. will now be described more fully hereinafter with reference to the accompanying drawings, in which example embodiments of the present disclosure are presented. In some embodiments, the mounting assembly is particularly well suited for use with a movable structure where it is beneficial to constrain movement of the covering portion of the architectural-structure covering to prevent the covering from moving significantly relative to the moveable structure as the movable structure is opened and/or closed (e.g., constrain movement of the covering while a window or door is tilted opened/closed or the door is moved opened/closed). The mounting assembly of the present disclosure may, however, be embodied in many different forms and should not be construed as being limited to the embodiments set forth herein. Rather, these embodiments are provided so that this disclosure will convey certain example aspects of the mounting assembly to those skilled in the art. In the drawings, like numbers refer to like elements throughout unless otherwise noted.

As will be described in greater detail below, the mounting assembly of the present disclosure may be used in connection with an architectural-structure covering. In use, the architectural-structure covering may be used to conceal and/or expose an architectural structure, which, without limitation, may be an opening such as a window, a doorway, an archway, a portion of a wall, or the like. It will be appreciated that references to an architectural structure are made for convenience, and without intent to limit the present disclosure to a particular structure.

As will be described in greater detail below, the mounting assembly may be used in combination with the architectural-structure covering so that the architectural-structure covering can be movable between a retracted position and an extended position. All the while, the mounting assembly may be adapted and configured to constrain movement of the covering portion of the architectural-structure covering relative to the underlying architectural structure (e.g., moveable structure) so that, for example, in use, when the mounting assembly is mounted to a French Door or adjacent a tilt window, the bottom portion of the covering is prevented from moving relative to the architectural structure (e.g., movable structure) when the movable structure is opened and closed.

In one non-limiting example embodiment, the mounting assembly may include a pair of side tracks for mounting on either side of the architectural structure (e.g., movable structure). The mounting assembly may further include mounting brackets for coupling a headrail of the architectural-structure covering to the side tracks, and rail clips for coupling a rail such as, for example, a bottom rail of the architectural-structure covering to the side tracks. In use, the rail clips are at least partially received within a channel formed in the side tracks. In addition, the rail clips are coupled to, for example, rail (e.g., a bottom rail) of the architectural-structure covering. The rail clips are movably positionable (e.g., slidable) with respect to the side tracks so that the rail clips, and hence the rail (e.g., bottom rail) of the architectural-structure covering coupled thereto, are movable between the extended and retracted positions. In this manner, the covering of the architectural-structure covering may be movable between extended and retracted positions, all the while, the rail (e.g., bottom rail) of the architectural-structure covering is constrained by the mounting assembly to prevent the covering from moving relative to the underlying architectural structure (e.g., movable structure).

In one non-limiting example embodiment, the rail clips are arranged and configured so that the covering of the architectural-structure covering is positioned forward of the first and second side tracks (e.g., in direction of the room and away from the underlying architectural structure) such that, in the extended configuration, the architectural-structure covering overlies the first and second side tracks.

Referring to FIG. 1, an example embodiment of a mounting assembly 200 for mounting to an architectural-structure covering 100 to an architectural structure 120 (illustrated as a French Door but which may be any movable structure such as, for example, a tilt window, a tilt & turn window, etc.) is shown. As illustrated, the architectural-structure covering 100 may include a headrail 102, a rail 104 (e.g., a bottom rail), and a covering 106 extending between the headrail 102 and the rail 104. In use, the architectural-structure covering 100 may be movably positionable between an extended position and a retracted position. While a stackable, honeycomb type architectural-structure covering is shown, it should be appreciated that the present disclosure is not so limited and that any type of architectural-structure covering may be used including, for example, rollable architectural-structure coverings.

In addition, while the mounting assembly 200 will be described and illustrated for use in connection with a standard, bottom-up architectural-structure covering (e.g., an architectural-structure covering where the headrail is mounted at or above a top end of the architectural structure and the bottom edge of the covering (e.g., bottom rail) moves relative to the upper edge of the covering so that the covering is movable between the extended and retracted positions), the mounting assembly may also be used in combination with a top-down, bottom-up architectural-structure covering (not shown) (e.g., an architectural-structure covering where either or both of the bottom edge of the covering and the upper edge of the covering are movable relative to each other so that the covering is movable between the extended and retracted positions). As will be appreciated by one of ordinary skill in the art, a top-down, bottom-up architectural-structure covering may include an additional, movable middle rail. During use, the top-down, bottom-up architectural-structure covering can be extended or retracted from either the top or the bottom (e.g., extended and/or retracted by moving the bottom rail and/or the middle rail).

Figure 2:
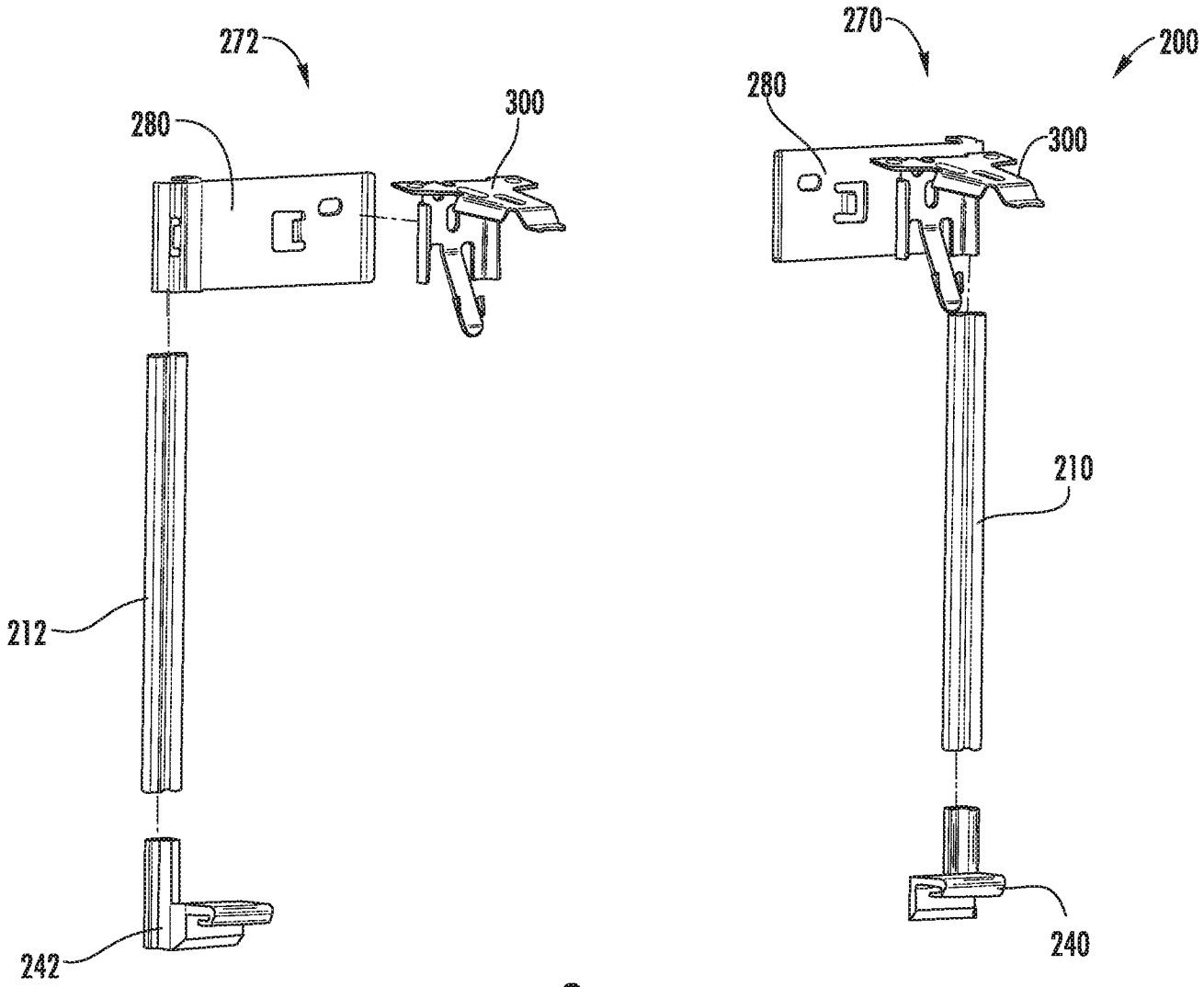
FIG. 2 is an exploded, perspective view of the mounting assembly shown in FIG. 1.
Figure 3:
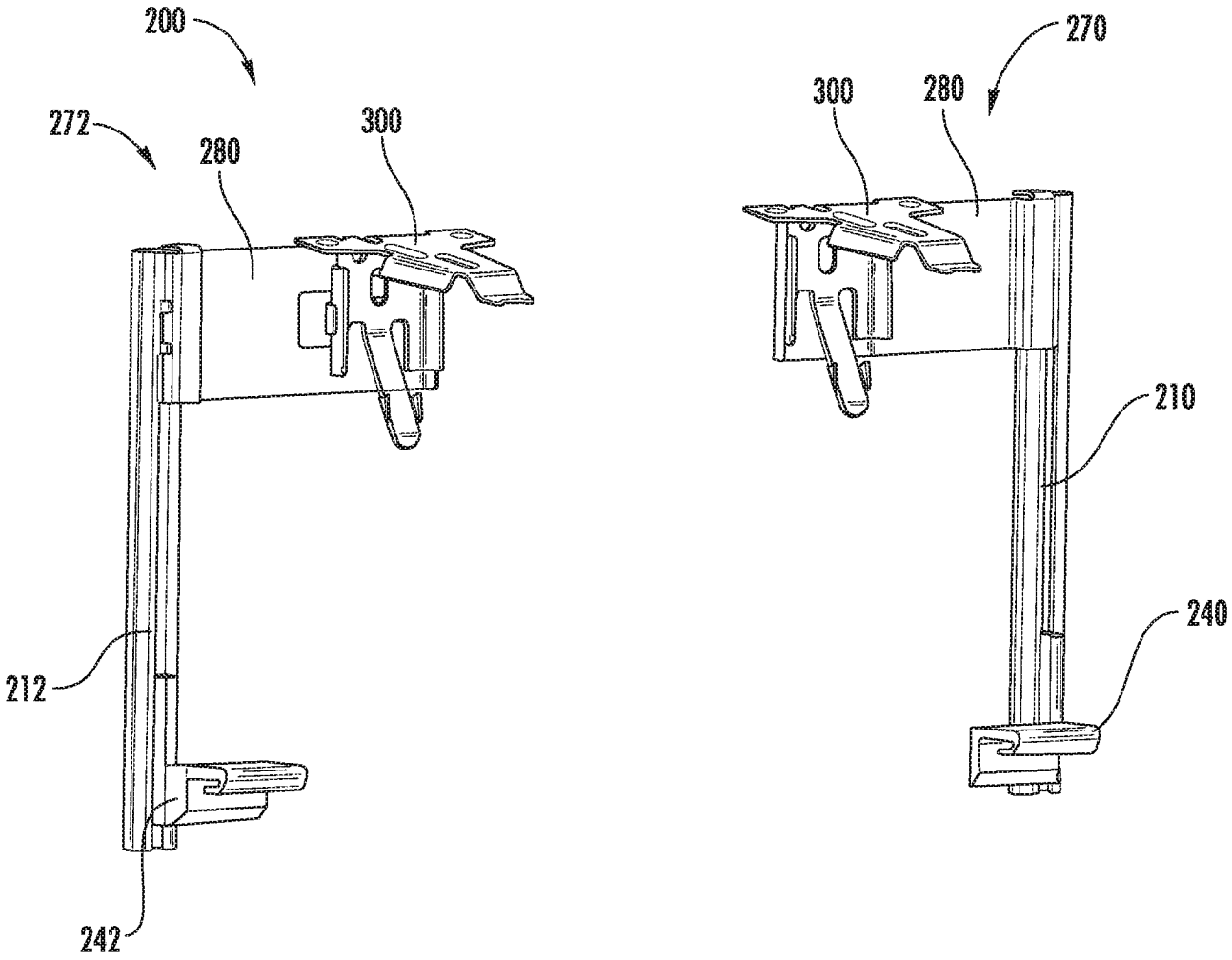
FIG. 3 is a perspective view of the mounting assembly shown in FIG. 1.

Referring to FIGS. 2 and 3, the illustrative example embodiment of a mounting assembly 200 includes first and second side tracks 210, 212, and first and second rail clips 240, 242. In addition, the mounting assembly 200 may include first and second mounting brackets 270, 272. In the illustrated embodiment, the first and second side tracks 210, 212 may be mounted to the movable structure, on opposite respective sides of, for example, a window. For example, as illustrated in FIG. 1, the first and second side tracks 210, 212 may be mounted on opposite respective sides of the window. The first and second side tracks 210, 212 may be mounted to the movable structure by any suitable mechanism now known or hereafter developed including, for example, an adhesive, fasteners, clips, double-sided tape, etc. In addition, and/or alternatively, the first and second side tracks 210, 212 may be mountable directly to, for example, a glass window. Alternatively, the first and second side tracks 210, 212 may be mounted to a frame adjacent to the window.

Figure 4:
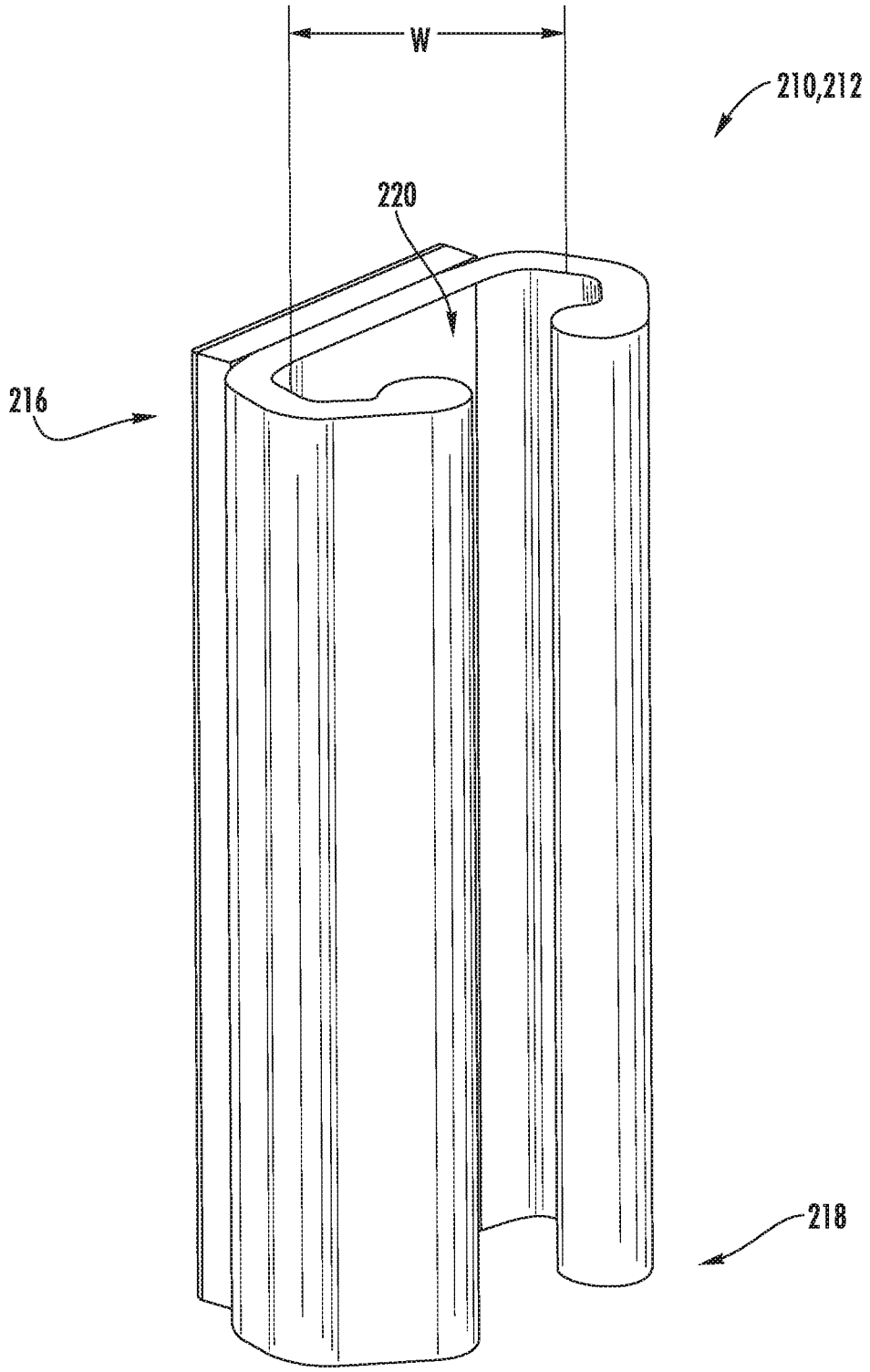
FIG. 4 is a partial, perspective view of an example embodiment of a side track used in combination with the mounting assembly shown in FIG. 1.

Referring to the example embodiment illustrated in FIG. 4, each of the first and second side tracks 210, 212 include a first or top end 216, a second or bottom end 218, and a channel 220 extending at least a substantial length thereof. In use, the channel 220 is adapted and configured to receive a portion of the first and second rail clips 240, 242. In addition, in one embodiment, in use, the channel 220 is adapted and configured to receive a portion of the first and second mounting brackets 270, 272 as well. As will be described in greater detail below, the first and second rail clips 240, 242 are received within the channel 220 formed in the first and second side tracks 210, 212, respectively, in a manner allowing the first and second rail clips 240, 242 to slide relative to the channels 220. In one embodiment, the first and second side tracks 210, 212 include a low profile so that they reside closer to the architectural structure 120 (e.g., movable structure) to which they are mounted. In one embodiment, a cord may be incorporated to extend and retract the covering 106. The cord may reside within the channel 220 of the first and second side track 210, 212.

Referring once again to FIGS. 2 and 3, the illustrated example embodiment of the first and second rail clips 240, 242 are configured to be coupled to a rail 104 (FIG. 1) such as, for example, a bottom rail of the architectural-structure covering 100 (FIG. 1). In addition, in use, the first and second rail clips 240, 242 may be coupled to and movably positionable (e.g., slidable) with respect to the first and second side tracks 210, 212 so that the covering 106 of the architectural-structure covering 100 can be movable between extended and retracted positions. As illustrated, in one embodiment, the first and second rail clips 240, 242 may be configured to be at least partially received in the channels 220 of the first and second side tracks 210, 212, respectively.

Referring to FIG. 1, as will be described in greater detail below, in one embodiment, the first and second rail clips 240, 242 are arranged and configured so that the covering 106 of the architectural-structure covering 100 is positioned forward of the first and second side tracks 210, 212 such that, in the extended position, the covering 106 and the rail 104 overlie the first and second side tracks 210, 212 thereby concealing, or at least partially concealing, the first and second side tracks 210, 212 from the user to provide a better aesthetic appearance.

Figure 5:
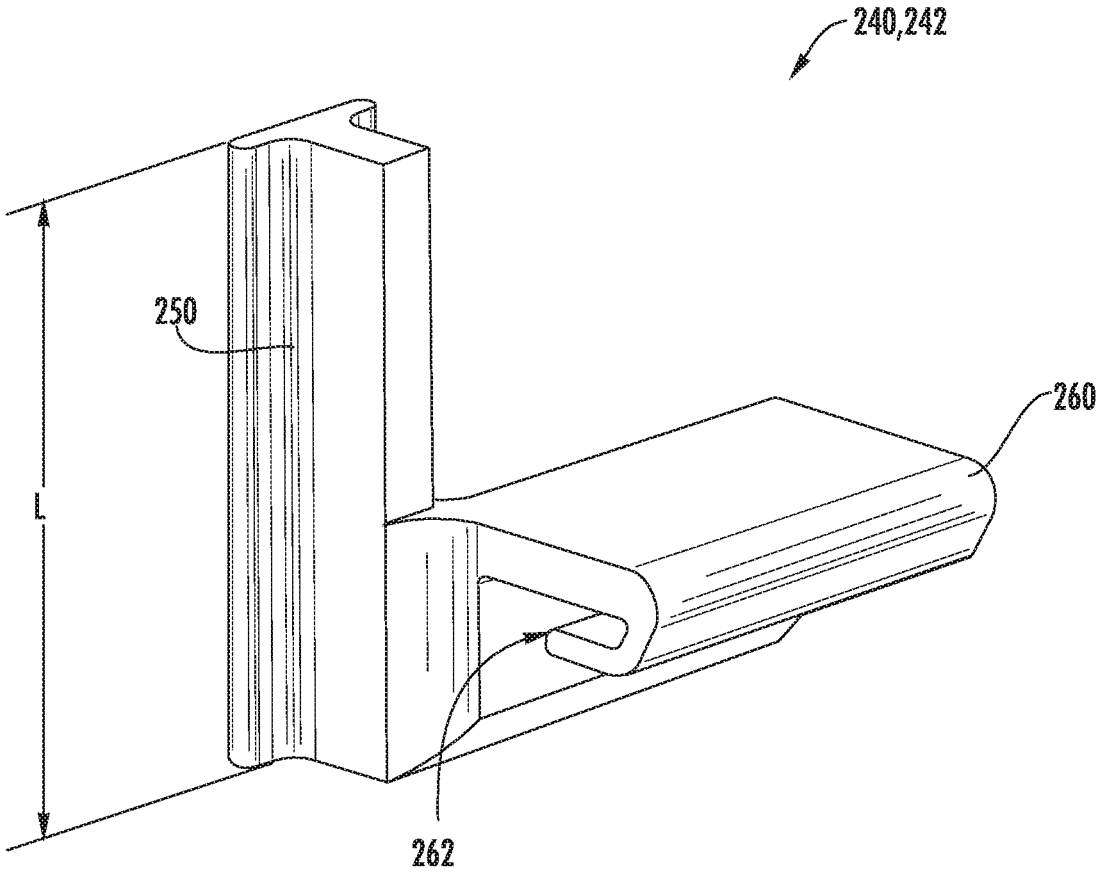
FIG. 5 is a perspective view of an example embodiment of a rail clip used in combination with the mounting assembly shown in FIG. 1.

Referring to FIG. 5, the example embodiment of the illustrated first and second rail clips 240, 242 include a side track member 250 for coupling to the first and second side tracks 210, 212, respectively, and a rail member 260 for coupling to a rail 104 (e.g., bottom or moving rail) of the architectural-structure covering 100. In one embodiment, as illustrated in FIG. 5, the rail clips may be integrally made.

Figure 6:
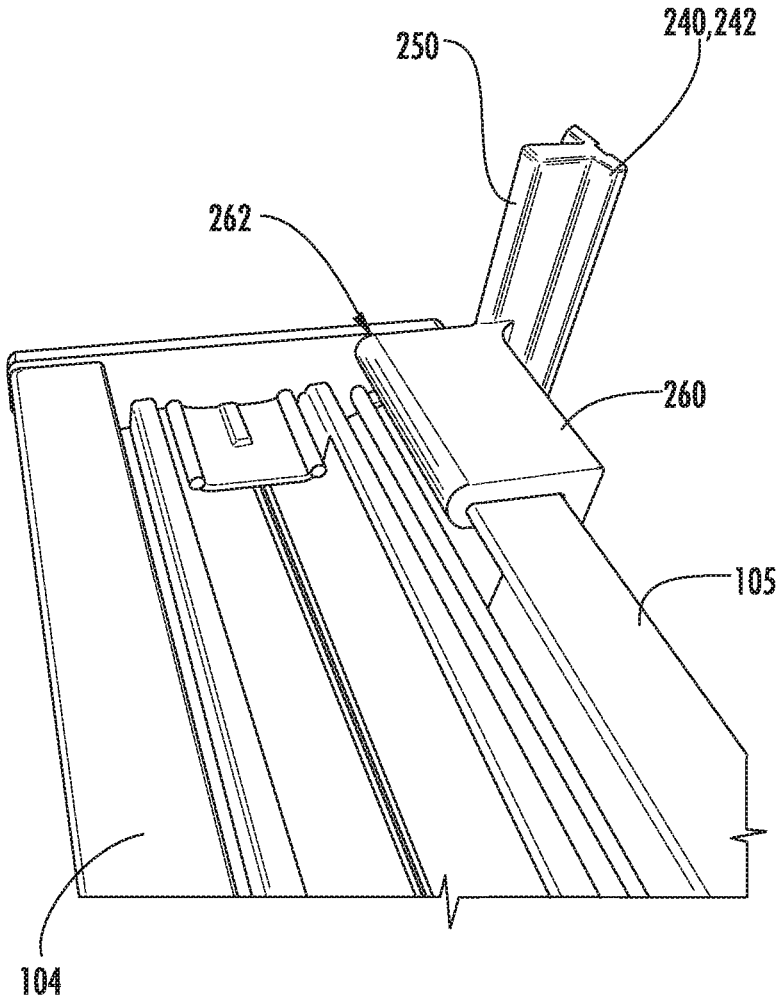
FIG. 6 is a partial, perspective view of the rail clip shown in FIG. 5 coupled to a rear edge of a bottom rail.

As illustrated, the rail member 260 may be coupled to the rail 104 (e.g., the bottom rail) of the architectural-structure covering 100 and the side track member 250 may be adapted and configured to be movably positioned with respect to the first and second side tracks 210, 212 (e.g., slidably received within the channel 220 of the first and second first and second side tracks 210, 212) so that, in use, the first and second rail clips 240, 242 may be slidable relative to the first and second side track 210, 212 so that the first and second rail clips 240, 242, and hence the rail 104 (e.g., bottom or moving rail) of the architectural-structure covering 100 coupled thereto, may be movable with respect to the headrail 102. Referring to FIG. 6, in one embodiment, the side track member 250 and the rail member 260 may be orthogonal with respect to each other so that the side track member 250 may be received within the channel 220 of the first and second side tracks 210, 212 and the rail member 260 may couple to a rear edge or portion 105 of the rail 104 (e.g., bottom rail) of the architectural-structure covering 100.

In use, the side track member 250 may have any corresponding shape configured to be received within the channel 220 of the first and second side tracks 210, 212. For example, as illustrated, the side track member 250 may have a general T-shaped configuration for being received within (e.g., inserted into) the channel 220 of the first and second side tracks 210, 212. By providing a side track member 250 having a general T-shape, the interaction between the T-shape side track member 250 and the channel 220 formed in the first and second side tracks 210, 212 acts to minimizing twisting, and drop out of the rail 104, thus assisting to maintain the rail 104 of the architectural-structure covering 100 stationary against the architectural structure 120 (e.g., movable structure). In one embodiment, the length L of the side track member 250 (as illustrated in FIG. 5) may be approximately three times (3×) as large as the width W of the channel 220 formed in the first and second side tracks 210, 212 (as illustrated in FIG. 4).

In one example embodiment, when used in connection with a top-down, bottom-up architectural-structure covering, the side track members 250 may include a nesting feature so that adjacent first and second rail clips 240, 242 residing within a single side track (e.g., within one of the first and second side tracks 210, 212) are adapted and configured to nest with each other to minimize a spacing or distance between different rails, such as, for example, between a bottom rail and an additional, movable middle rail, as will be described in greater detail. For example, referring to FIG. 7, in one illustrated embodiment, each of the side track members 250' may incorporate a tapered surface 255. By providing corresponding tapered surfaces 255, adjacent first and second rail clips 240, 242 are configured to nest with each other when moved together thus minimizing the overall distance between rails such as, for example, the distance between a bottom rail and a movable middle rail.

As will be appreciated by one of ordinary skill in the art, providing tapered surfaces 255 is especially beneficial in a top-down, bottom-up architectural-structure covering where the architectural-structure covering includes an additional, movable middle rail so that the covering can be extended or retracted from either the top or the bottom (e.g., extended and/or retracted by moving the bottom rail or the middle rail). In this embodiment, the middle rail, similar to the bottom rail, may be coupled to the first and second side tracks 210, 212 by first and second rail clips 240, 242 so that the middle rail can be slidable with respect to the first and second side tracks 210, 212. That is, when used in combination with a top-down, bottom-up architectural-structure covering, the mounting assembly 200 may include first and second side tracks 210, 212, first and second bottom rail clips 240, 242, and first and second middle rail clips 240, 242. In use, the first and second side tracks 210, 212 may be mounted on opposite respective sides of an architectural structure. The first and second middle rail clips 240, 242 are coupled to a middle rail of the architectural-structure covering, while the first and second bottom rail clips 240, 242 are coupled to a bottom rail of the architectural-structure covering. The first and second middle rail clips 240, 242, and the first and second bottom rail clips 240, 242 are configured to be at least partially received in the channels 220 of the first and second side tracks 210, 212, respectively, the first and second middle rail clips 240, 242, and the first and second bottom rail clips 240, 242 are slidable with respect to the first and second side tracks 210, 212 so that the middle rail and the bottom rail are slidable with respect to the first and second side tracks 210, 212. In addition, the mounting assembly 200 may include first and second mounting brackets 270, 272 coupled to a headrail of the architectural-structure covering, the first and second mounting brackets 270, 272 configured to be at least partially received in the channels 220 of the first and second side tracks 210, 212, respectively.

Figure 7:
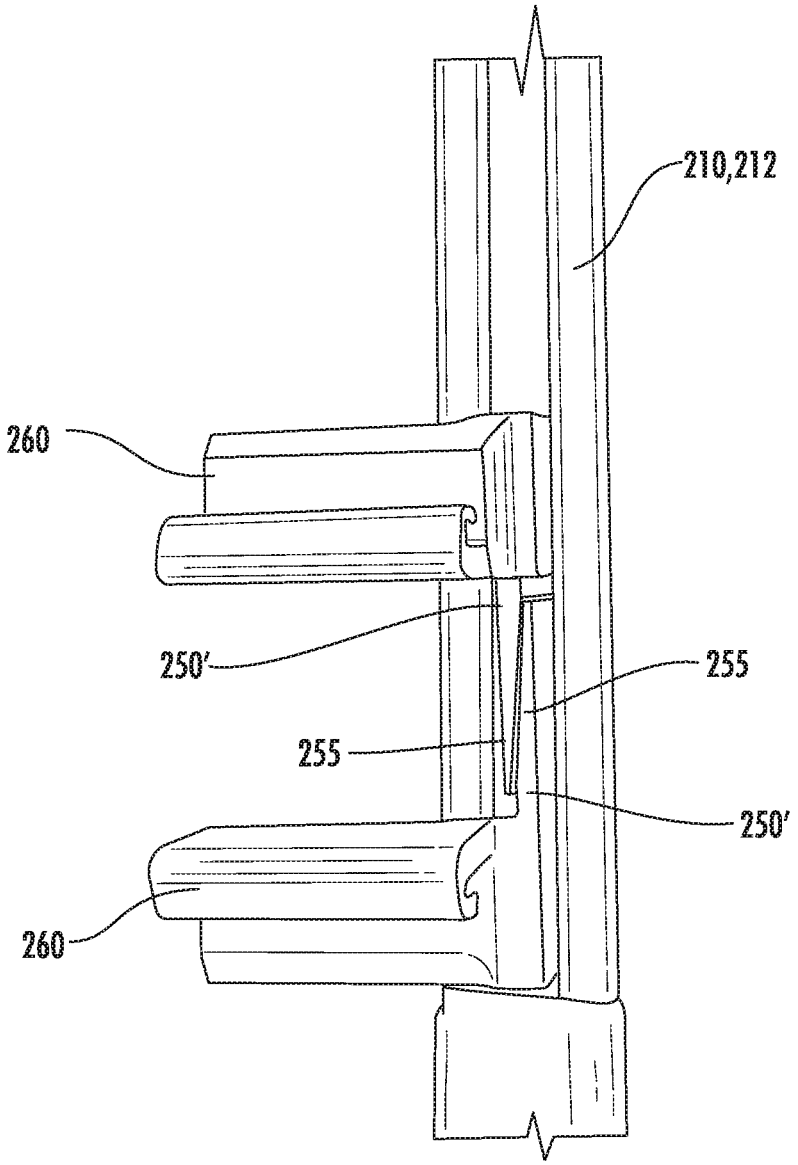
FIG. 7 is a front view of an alternate example embodiment of a rail clip used in combination with the mounting assembly shown in FIG. 1, the rail clip incorporating nested surfaces.

As illustrated in the example embodiment of FIG. 7, the side track members 250' of adjacent first and second rail clips 240, 242 residing in a single side track include corresponding tapered surfaces 255 so that the side track member 250' of the bottom rail of the architectural-structure covering may be nestable (e.g., partially overlap with) with the tapered surface 255 of the side track member 250' of the middle rail. In this manner, when the middle rail and the bottom rail of the architectural-structure covering are moved into a retracted configuration, the middle rail and the bottom rail of the architectural-structure covering reside in a more compact configuration (e.g., the middle rail and the bottom rail are closer together) as compared to prior designs which do not incorporate any nesting feature. It should be understood that, in use, it is envisioned that the rail clip used in connection with a top-down and bottom-up architectural-structure covering, may be any rail clip now known or hereafter developed including any rail clip described herein including, for example, the multi-piece rail clip as will be described in greater detail below.

As generally illustrated in FIG. 1, in use, the first and second rail clips 240, 242 may be coupled to the rail 104 (e.g., bottom or moving rail) of the architectural-structure covering 100 on either side thereof. The first and second rail clips 240, 242 may be coupled to the rail 104 by any mechanism now known or hereafter developed. As illustrated in FIGS. 5 and 6, the first and second rail clips 240, 242 include a rail member 260 for engaging a portion of the rail 104. In the illustrated embodiment, the rail member 260 is in the form of a hook 262 for coupling to a rear edge or portion 105 of the rail 104 (e.g., bottom or moving rail). In this manner, the first and second rail clips 240, 242 are coupled the rail 104 (e.g., bottom or moving rail) of the architectural-structure covering 100 from a rear side (e.g., structure or window facing side, non-room facing side) thereof. As such, the first and second rail clips 240, 242 engage a rear side of the rail (e.g., edge closest to the architectural-structure). By coupling the first and second rail clips 240, 242 to the rear edge or portion 105 of the rail 104 of the architectural-structure covering 100, the first and second side tracks 210, 212 are located behind the covering 106 and thus hidden from view when the covering 106 is in the extended position, thus providing an improved aesthetic finish.

Referring to FIGS. 8-12, in an alternate embodiment, the first and second rail clips 340, 342 may be manufactured from two or more components or pieces that are operatively coupled together. That is, in one embodiment, the first and second rail clips 340, 342 may be manufactured from multiple, separate, and distinct components. For example, the side track clip member 350 and the rail clip member 360 of the first and second rail clips 340, 342 may be separately manufactured with respect to each other and then coupled together. That is, the first and second rail clips 340, 342 may each include a rail clip member 360 for coupling to the rail 104 of the architectural-structure covering 100, and a side track clip member 350 for being at least partially received in the channels 220 of the first and second side tracks 210, 212. The side track clip member 350 is operatively coupled to the rail clip member 360. In use, the multi-piece first and second rail clips 340, 342 function substantially similar to the one-piece first and second rail clips 240, 242 described and illustrated above in connection with FIG. 5 but for the differences described herein. As will be described herein, the multi-piece rail clip enables easier installation and removal of the components as necessary.

By incorporating a multiple-piece rail clip, during installation, the rail clip member 360 may be operatively coupled to the rail 104 (e.g., bottom or moving rail) of the architectural-structure covering 100. The side track clip member 350 may be operatively configured to be at least partially received within the channel 220 formed in the first and second side tracks 210, 212.

Figure 9:
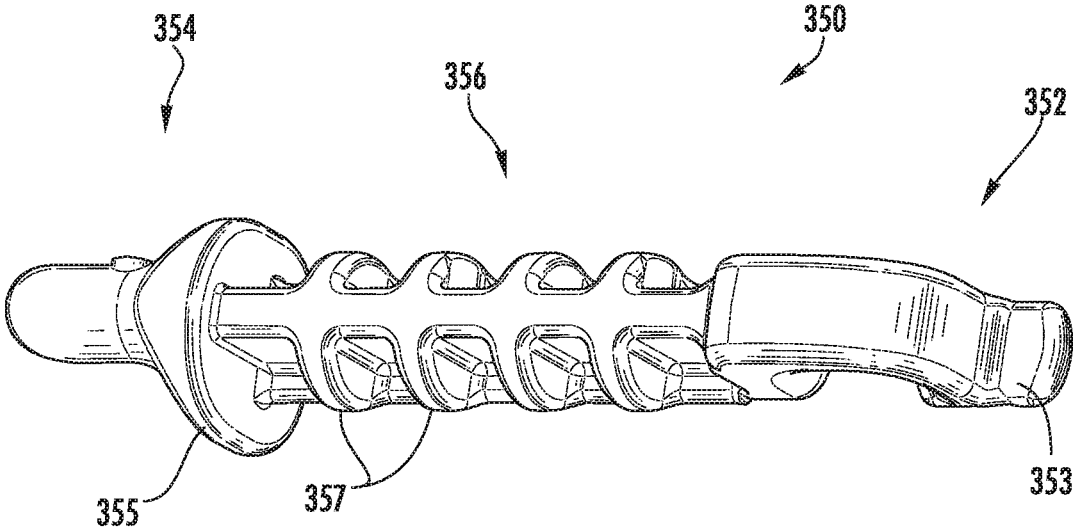
FIG. 9 is a front, perspective view of an example embodiment of a side track clip member of the rail clip shown in FIG. 8.
Figure 10:
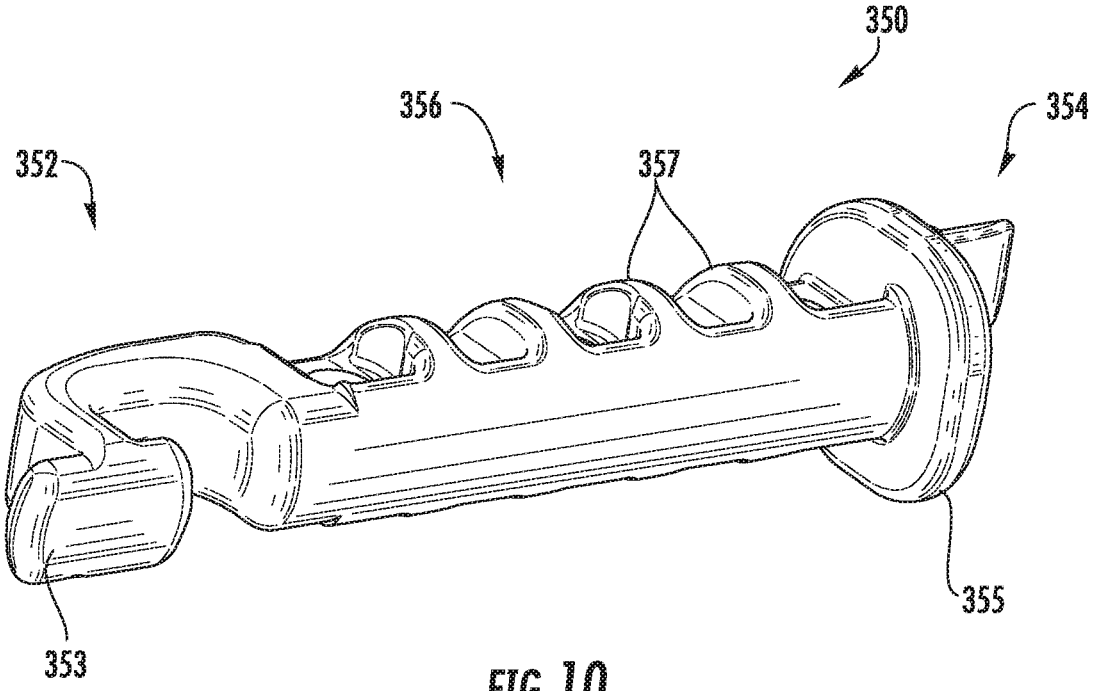
FIG. 10 is a rear, perspective view of the side track clip member of the rail clip shown in FIG. 8.

Referring to FIGS. 9 and 10, the side track clip member 350 may include a first end 352, a second end 354, and an intermediate portion (e.g., projection) 356 located between the first and second ends 352, 354.

As illustrated and similar to the first and second rail clips 240, 242 described and illustrated above in connection with FIG. 5, the first end 352 of the side track clip member 350 includes a channel member 353 positionable in the channel 220 formed in the first and second side tracks 210, 212. In use, the side track clip members 350 are slidably positioned within the channel 220 of the first and second side tracks 210, 212 so that the first and second rail clips 340, 342, and hence the rail 104 (e.g., bottom or moving rail) of the architectural-structure covering 100 coupled thereto, are movable with respect to the headrail 102. As illustrated, for example, the first end 352 may include a T-shaped configuration for coupling to or being inserted into the channel 220 formed in the first and second side tracks 210, 212, although, as previously described in connection with FIG. 5, the side track clip member 350 may have other corresponding shapes configured to be received within the channel 220 formed in the first and second side tracks 210, 212. By incorporating a first end 352 having a T-shaped configuration, the interaction between the first end 352 having a T-shaped configuration and the channel 220 formed in the first and second side tracks 210, 212 act to minimizing twisting and drop out of the rail 104, keeping the rail 104 stationary against the architectural structure. As previously mentioned, in one embodiment, the length of the first end 352 having a T-shaped configuration may be three times (3×) as large as the width of the channel 220 formed in the first and second side tracks 210, 212.

Figure 8:
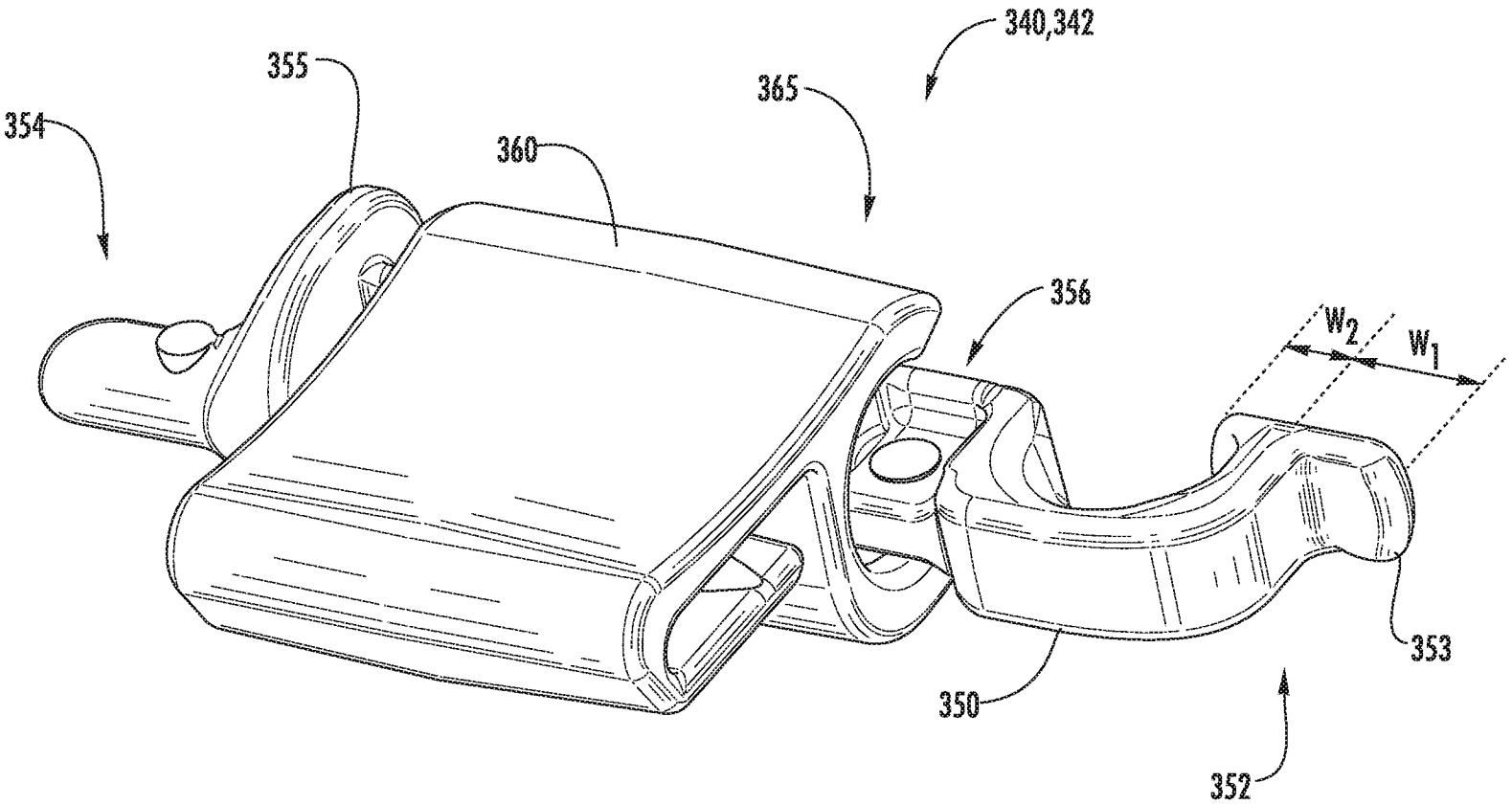
FIG. 8 is a perspective view of another example embodiment of a rail clip used in combination with the mounting assembly shown in FIG. 1.

Moreover, as illustrated in FIG. 8, one side of the "T" may have a width $W_1$ than is greater than the width $W_2$ of the other side of the "T". In this manner, the side track clip members 350 may be cammed into and out of the channel 220 formed in the first and second side tracks 210, 212 at any position along the length of the first and second side tracks 210, 212, which enables easier installation as it prevents having to insert the side track clip members 350 from the top or bottom ends 216, 218 of the first and second side tracks 210, 212.

The second end 354 of the side track clip member 350 may include an enlarged end portion 355 adapted and configured to prevent or render more difficult lateral dislodgment of the rail clip member 360, thus assisting with maintaining the rail clip member 360 in proper position. That is, the enlarged end portion 355 is dimensioned to prevent the rail clip member 360 from accidentally dislodging from the side track clip member 350 (e.g., prevent lateral disengagement of the rail clip member 360 with respect to the side track clip member 350).

As will be described in greater detail, the intermediate portion 356 of the side track clip member 350 may be adapted and configured to couple to the rail clip member 360. For example, the intermediate portion 356 may be adapted and configured to couple to an opening 365, for example, a "C-shaped" opening formed in the rail clip member 360. As illustrated, in one embodiment, the intermediate portion 356 of the side track clip member 350 may include a plurality of ridges 357 for facilitating better connection between the side track clip member 350 and the rail clip member 360. In addition, the plurality of ridges 357 may facilitate gripping by an installer thus enabling easier installation.

Figure 11:
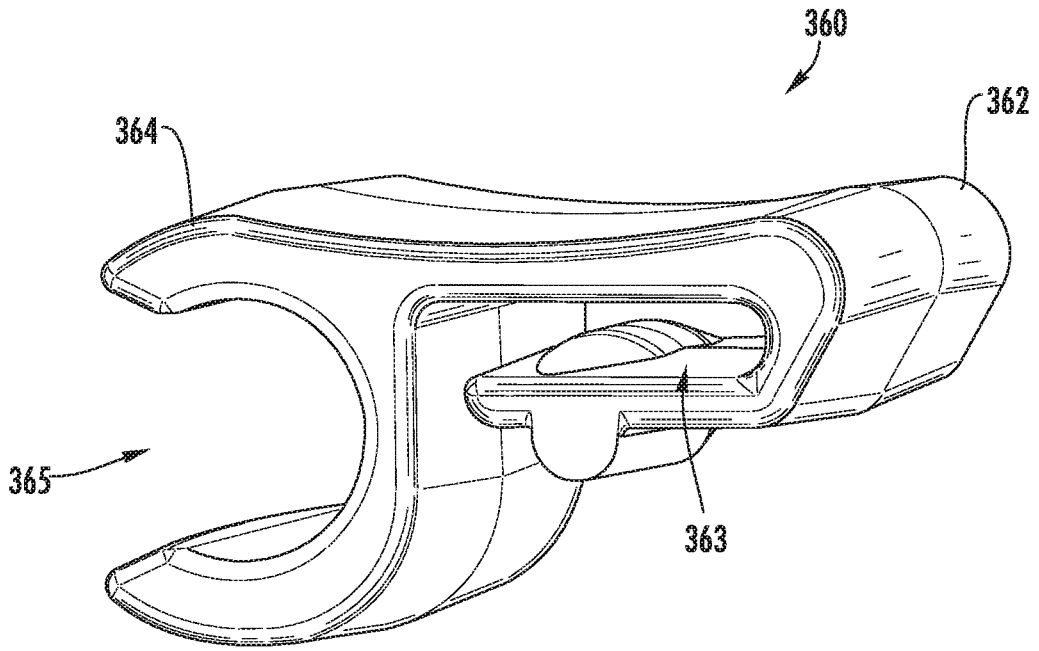
FIG. 11 is a front, perspective view of an example embodiment of a rail clip member of the rail clip shown in FIG. 8.
Figure 12:
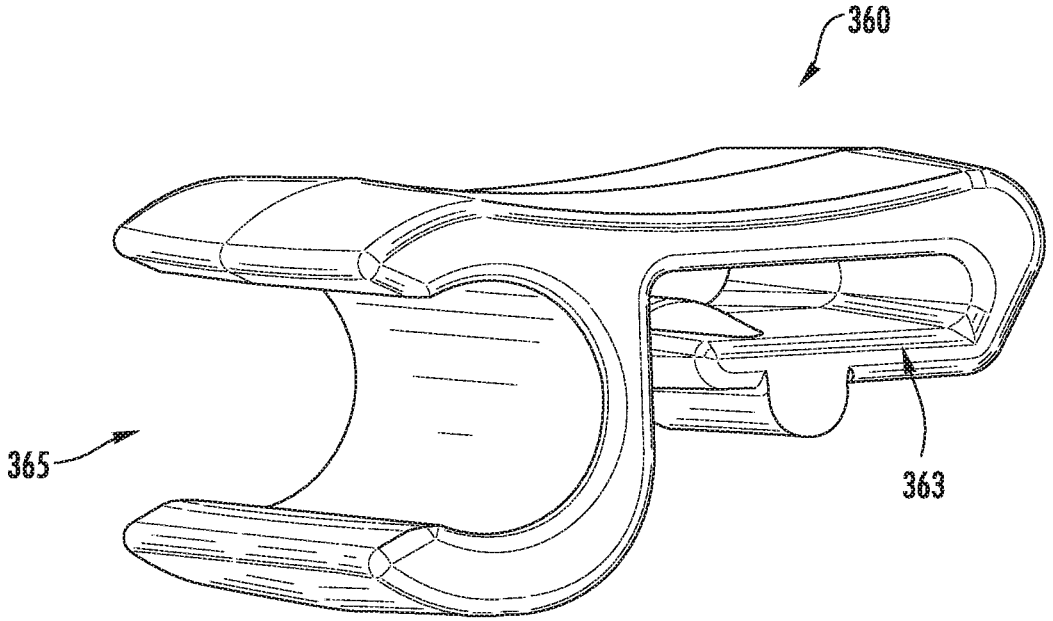
FIG. 12 is a rear, perspective view of the rail clip member of the rail clip shown in FIG. 8.

Referring to FIGS. 11 and 12, the rail clip member 360 includes a first end 362 and a second end 364. Similar to the first and second rail clips 240, 242 described and illustrated in connection with FIG. 5, the first end 362 of the rail clip member 360 may have any shape adapted and configured for coupling to the rail 104 (e.g., bottom or moving rail) of the architectural-structure covering 100. For example, as illustrated in FIGS. 11 and 12, the first end 362 may include a hook member 363 for coupling to or receiving a rear edge or portion 105 of the rail 104 (FIG. 6) (e.g., bottom or moving rail) of an architectural-structure covering 100. In this manner, the rail clip member 360 may couple the rail 104 (e.g., bottom or moving rail) of an architectural-structure covering 100 from a rear side thereof. As such, the first and second rail clips 340, 342 preferably engage a rear side of the rail 104 (e.g., bottom or moving rail) of an architectural-structure covering 100.

In use, the rail clip member 360 may be coupled to the side track clip member 350 of the first and second rail clips 340, 342 by any mechanism now known or hereafter developed including, for example, a pin and socket connection, a snap-fit connection, a pressure fit connection, or the like. As illustrated, the second end 364 of the rail clip member 360 may include an opening 365, for example, a "C-shaped" opening formed therein for coupling to the side track clip member 350 (e.g., for receiving or snap-fitting to the intermediate portion 356 of the side track clip member 350).

By utilizing a multi-piece first and second rail clips 340, 342 having separately formed rail and side track clip members 350, 360, the rail clip member 360 of the first and second rail clips 340, 342 may be coupled to the side track clip member 350 of the first and second rail clips 340, 342 via a flexible connection such as, for example, via a pin and socket connection formed by, for example, coupling the opening 365 (e.g., C-shaped opening) formed on the second end 364 of the rail clip member 360 with the intermediate portion 356 of the side track clip member 350. In use, the pin and socket connection enables the rail clip member 360 to couple to (e.g., snap onto) the side track clip member 350 while enabling easier installation and removal, and enabling the rail clip member 360 to rotate freely relative to the side track clip member 350 during use to enable rotation, which may occur during normal operation, of the rail 104 (e.g., bottom or moving rail) of the architectural-structure covering 100 and smoother operation of the architectural-structure covering 100. That is, during use, the pin and socket connection allows for the rail clip member 360 to be coupled to the side track clip member 350 while also enabling the rail clip member 360 to be disconnected from the side track clip member 350 if, for example, the rail 104 (e.g., bottom or moving rail) of the architectural-structure covering 100 is pulled with too much force. For example, if the rail 104 of the architectural-structure covering 100 is pulled away from the window or door, the rail clip member 360 may disconnect from the side track clip members 350 via the opened "C-shaped" opening 365 formed in the rail clip members 360 leaving the side track clip members 350 connected to the first and second side tracks 210, 212 for easy re-connection.

As previously mentioned, the mounting assembly 200 may also include first and second mounting brackets 270, 272. In use, the first and second mounting brackets 270, 272 are adapted and configure to be at least partially received within the first and second side tracks 210, 212, at the top end 216 of the first and second side tracks 210, 212, and may be mounted to a headrail 102 of the architectural-structure covering 100. As such, in use, the first and second mounting brackets 270, 272 couple the headrail 102 of the architectural-structure covering 100 to the first and second side tracks 210, 212 of the mounting assembly 200. In this manner, the first and second mounting brackets 270, 272 couple the headrail 102 of the architectural-structure covering 100 to the first and second side tracks 210, 212, preferably at the top end 216 thereof, on either side of the window. In one embodiment, the first and second mounting brackets 270, 272 are fixedly positioned with respect to the first and second side tracks 210, 212 (e.g., the position of the first and second mounting brackets 270, 272, and hence the headrail 102, is not movable relative to the first and second side tracks 210, 212).

The first and second mounting brackets 270, 272 may be coupled to a headrail 102 of the architectural-structure covering 100 by any mechanism now known or hereafter developed. In addition, the first and second mounting brackets 270, 272 may be coupled to the first and second side tracks 210, 212 by any mechanism now known or hereafter developed. As illustrated, in one embodiment, the first and second mounting brackets 270, 272 are adapted and configured to be at least partially received in the channels 220 of the first and second side tracks 210, 212, respectively. The first and second mounting brackets 270, 272 are arranged and configured so that the covering 106 of the architectural-structure covering 100 is positioned forward of the first and second side tracks 210, 212 such that, in the extended configuration, the architectural-structure covering 100 overlies the first and second side tracks 210, 212.

Figure 13:
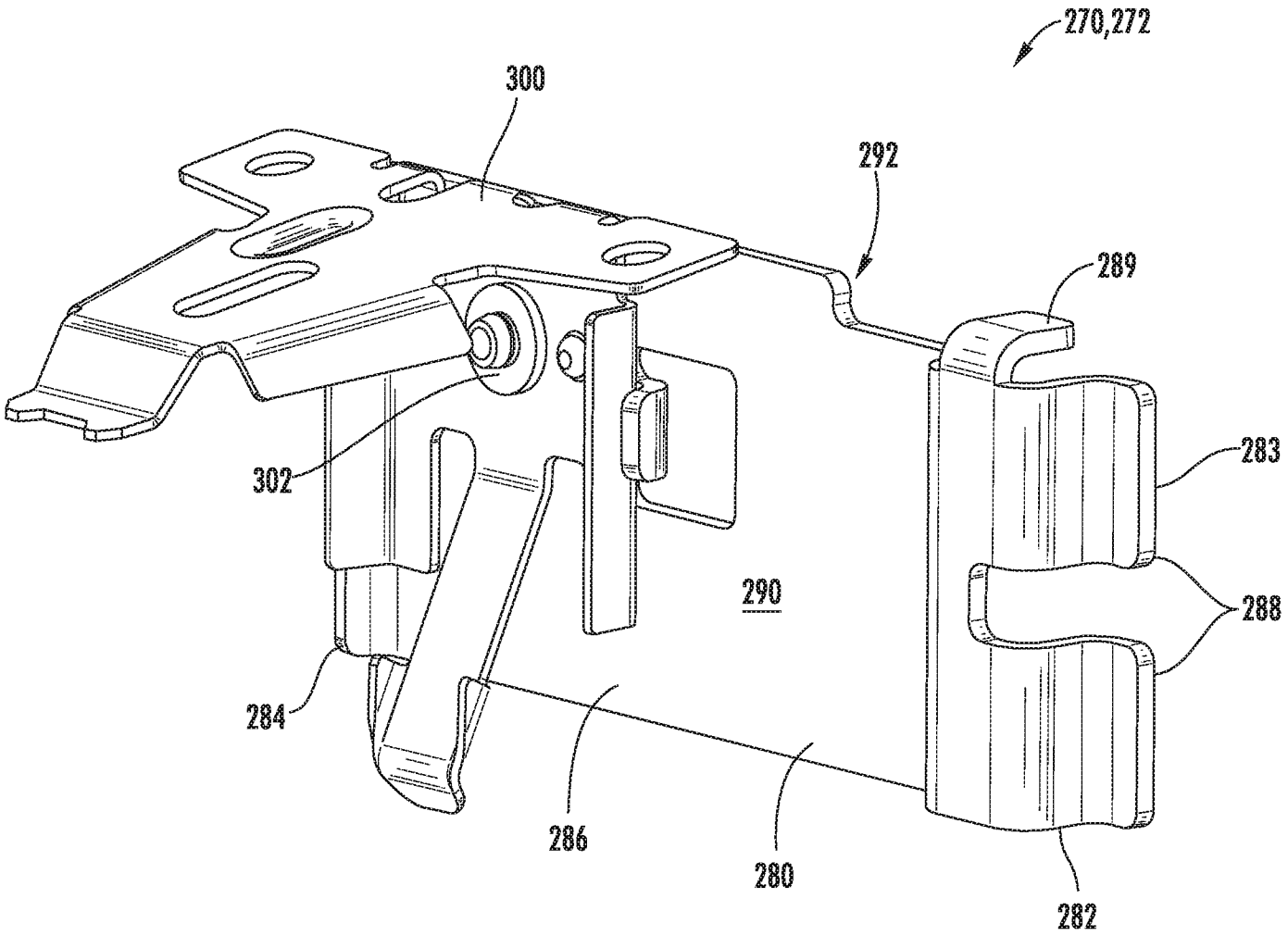
FIG. 13 is a front, perspective view of an example embodiment of a mounting bracket used in combination with the mounting assembly shown in FIG. 1.

Referring to FIG. 13, in one embodiment, each of the first and second mounting brackets 270, 272 includes a plate portion 280 and a bracket portion 300. The plate portion 280 may include a first side 282, a second side 284, and an intermediate portion 286 extending between the first and second sides 282, 284. As illustrated, the first side 282 of the plate portion 280 may include a channel member 283 sized and configured for being received within the channel 220 formed in the first and second side tracks 210, 212. The channel member 283 may have any suitable shape for being received within the channel 220. As illustrated, the channel member 283 may be in the form of a leg 288 sized and shaped for receipt within the channel 220 of the first and second side tracks 210, 212. The first side 282 of the plate portion 280 may also include a stop member 289 for contacting the top end 216 of the first and second side tracks 210, 212 to inhibit the first and second mounting brackets 270, 272 from moving with respect to the first and second side tracks 210, 212, respectively (e.g., to inhibit the first and second mounting brackets 270, 272, and hence the headrail 102, from moving downwards relative to the first and second side tracks 210, 212).

The bracket portion 300 may be coupled to the plate portion 280 by any suitable mechanism now known or hereafter developed including, for example, adhesive, welding, etc. In the illustrated embodiment, each of the plate portions 280 of the first and second mounting brackets 270, 272 includes a front surface 290 (e.g., room facing surface) and a rear surface 292 (e.g., structure facing surface). The bracket portion 300 is coupled to the front surface 290 of the intermediate portion 286 of the plate portion 280. As illustrated, the plate portion 280 and the bracket portion 300 are orthogonally positionable with respect to each other so that, when coupled, said plate portion 280 lies orthogonal to its respective side track 210, 212. The bracket portion 300 may be coupled to the plate portion 280 via a fastener 302. In use, the bracket portion 300 is arranged and configured to engage the headrail 102 of the architectural-structure covering 100. In the illustrated embodiment, the bracket portion 300 may be a standard metal bracket used to mount the headrail 102.

Figure 14:
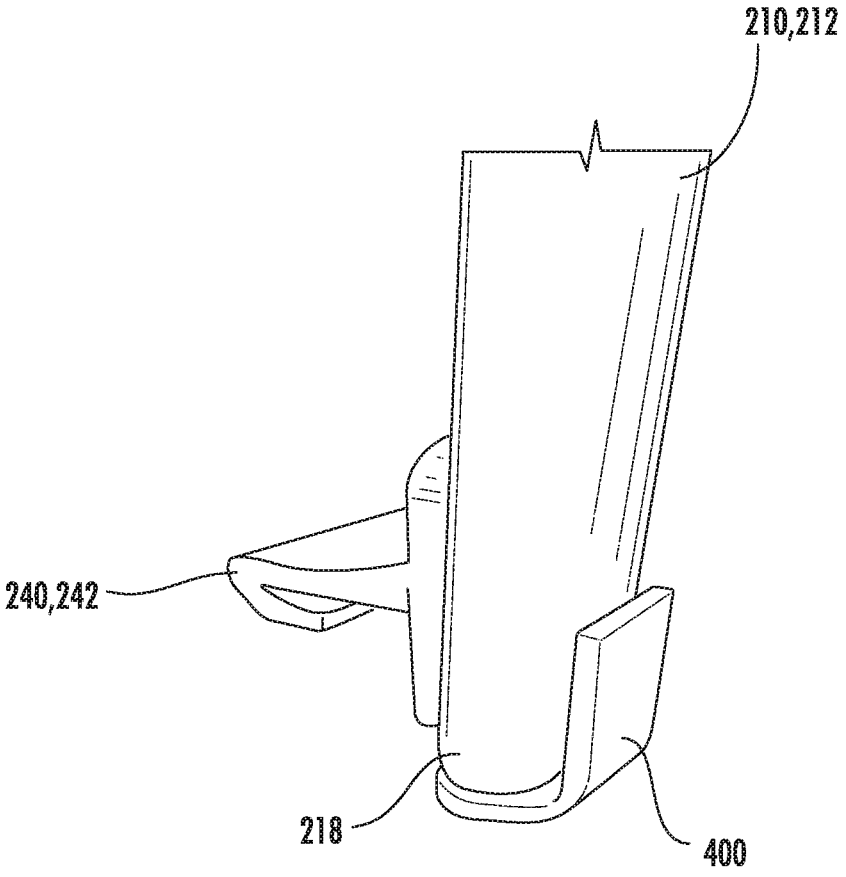
FIG. 14 is a side, perspective view of an example embodiment of a cap used in combination with the mounting assembly shown in FIG. 1.

Referring to FIG. 14, the mounting assembly 200 may also include one or more caps 400 for coupling to the bottom end 218 of the first and second side tracks 210, 212. In use, the caps 400 may be coupled to the first and second side tracks 210, 212 by any mechanism now known or hereafter developed. For example, the caps 400 may be friction-fitted, snap-fitted, adhered, fastened, etc. By incorporating the caps 400, an aesthetically pleasing finish is provided to the ends of the first and second side tracks 210, 212 as needed. In addition, the caps 400 prevent the rail 104 from being overextended and thus causing the rail clips 240, 242, 340, 342 to exit the first and second side tracks 210, 212.

While the present disclosure makes reference to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of covering. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

What is claimed:

1. An architectural-structure assembly comprising:

an architectural-structure covering including:

a covering portion moveable between a retracted configuration and an extended configuration; and a bottom rail coupled to a bottom portion of the covering portion, the bottom rail including a front portion, a rear portion opposite the front portion, and a bottom portion extending between the front and rear portions; and a mounting assembly comprising:

first and second side tracks configured to be mounted on opposite respective sides of an architectural structure, each of said first and second side tracks including a first end, a second end, and a channel; and first and second rail clips coupled to the rear portion of the bottom rail of the architectural-structure covering, said first and second rail clips configured to be at least partially received in said channel of said first and second side tracks, respectively, said first and second rail clips being slidable with respect to said first and second side tracks so that the covering portion of the architectural-structure covering is moveable between said retracted configuration and said extended configuration, said first and second rail clips coupled to the rear portion of the bottom rail so that the covering portion of the architectural-structure covering is positioned forward of said first and second side tracks such that, in said extended configuration, said architectural-structure covering overlies said first and second side tracks;

wherein each of said first and second rail clips include:

a rail clip member for coupling to said rail of said architectural-structure covering; and a side track clip member separate from and directly coupled to said rail clip member, said side track clip member including a channel member for being at least partially received in said channels of said first and second side tracks, said side track clip member being movably coupled to said rail clip member so that said rail clip member and said side track clip member are movable relative to each other.

2. The architectural-structure assembly of claim 1, wherein the mounting assembly further comprises first and second brackets for coupling to a headrail of the architectural-structure covering, said first and second brackets configured to be at least partially received in said channel of said first and second side tracks, respectively; said first and second brackets being arranged and configured so that the covering portion of the architectural-structure covering is positioned forward of said first and second side tracks such that, in said extended configuration, said architectural-structure covering overlies said first and second side tracks.

3. The architectural-structure assembly of claim 2, wherein each of said first and second brackets includes a plate portion and a bracket portion, said plate portion including a leg configured to be received within said channel of said first and second side tracks, respectively.

4. The architectural-structure assembly of claim 3, wherein said plate portion and said bracket portion are orthogonally positionable with respect to each other so that, when coupled, said plate portion lies orthogonal to its respective side track.

5. The architectural-structure assembly of claim 3, wherein said plate portion includes a stop member to prevent said first and second brackets from moving with respect to said first and second side tracks, respectively.

6. The architectural-structure assembly of claim 3, wherein each of said plate portion includes a front surface and a rear surface, said bracket portion being coupleable to said front surface of said plate portion.

7. The architectural-structure assembly of claim 1, wherein said side track clip member is coupled to said rail clip member via a pin and socket connection.

8. The architectural-structure assembly of claim 1, wherein said rail clip member includes an opening for coupling to a projection extending from said side track clip member.

9. The architectural-structure assembly of claim 8, wherein said opening has a C-shaped opening to enable coupling and removal of said rail clip member to and from said side track clip member.

10. The architectural-structure assembly of claim 9, wherein said projection formed on said side track clip member includes an enlarged end portion dimensioned to prevent lateral disengagement of said rail clip member from said side track clip member.

11. The architectural-structure assembly of claim 1, wherein said channel member includes a T-shaped configuration having a first leg having a first width and a second leg having a second width, said first width being greater than said second width to enable insertion of said channel member within said channel formed in said first and second side tracks at any position along a length of said channel formed in said first and second side tracks.

12. The architectural-structure assembly of claim 1, wherein said rail clip member and said channel member are orthogonally positionable with respect to each other.

13. The architectural-structure assembly of claim 1, wherein said rail clip member includes a hook member for coupling to the rear portion of the bottom rail.

14. The architectural-structure assembly of claim 1, wherein said first and second side tracks are mounted to one of a glass window or a frame adjacent to the glass window.

15. The architectural-structure assembly of claim 1, wherein the architectural structure covering includes a second rail coupled to a top portion of the covering portion, the mounting assembly further comprises third and fourth rail clips for coupling to the second rail of the architectural-structure covering, wherein each of said side track clip member of said rail clips is configured to be nested with another respective side track clip member to decrease a spacing between the second rail and the bottom rail when the architectural-structure covering is in the retracted configuration.

* * * * *